United States Patent [19]

Würtz et al.

[11] Patent Number: 4,722,658

[45] Date of Patent: Feb. 2, 1988

[54] LOADING APPARATUS FOR EMPTYING CONTAINERS INTO A COMMON RECEPTACLE

[75] Inventors: Renate Würtz, Erligheim; Jakob Naab, Mainz-laubenheim, both of Fed. Rep. of Germany

[73] Assignee: Zoller-Kipper GmbH, Mainz-laubenheim, Fed. Rep. of Germany

[21] Appl. No.: 767,308

[22] Filed: Aug. 19, 1985

[30] Foreign Application Priority Data

Aug. 21, 1984 [DE] Fed. Rep. of Germany ..... 3430643
Jul. 27, 1985 [DE] Fed. Rep. of Germany ..... 3527022

[51] Int. Cl.[4] ..... B65F 3/04

[52] U.S. Cl. ..... 414/408; 414/406; 414/404; 414/421; 414/546; 414/732; 414/555; 414/550; 901/47

[58] Field of Search ..... 414/407, 406, 550, 546, 414/408, 404, 403, 419, 420, 421, 422, 423, 424, 547, 555, 696, 732, 743, 729, 540, 783, 680, 730; 901/46, 47

[56] References Cited

U.S. PATENT DOCUMENTS

| | | | |
|---|---|---|---|
| 933,683 | 9/1909 | Watson | 414/696 X |
| 3,269,572 | 8/1966 | Felts | 414/406 |
| 3,604,577 | 9/1971 | Hellmeier | 414/421 |
| 3,765,554 | 10/1973 | Morrison | 414/555 X |
| 3,889,829 | 6/1975 | Dutton | 414/732 |
| 3,952,880 | 4/1976 | Hill et al. | 901/46 |
| 4,175,903 | 11/1979 | Carson | 414/408 |
| 4,551,057 | 11/1985 | Naab | 414/420 |

FOREIGN PATENT DOCUMENTS

| | | | |
|---|---|---|---|
| 1282547 | 11/1968 | Fed. Rep. of Germany | 414/408 |
| 1009926 | 4/1983 | U.S.S.R. | 414/408 |
| 1043077 | 9/1983 | U.S.S.R. | 414/408 |

*Primary Examiner*—Frank E. Werner
*Attorney, Agent, or Firm*—Karl F. Ross; Herbert Dubno

[57] ABSTRACT

A loading apparatus for emptying containers into a common receptacle comprises a pick-up attachment and pick-up support for the containers to be emptied, which is further structured and improved, so that the pick-up attachment and the pick-up support are mounted with a limited movability on a dump frame of the loading apparatus in order to be movable toward the container to be picked up and from the properly deposited container. As the container is raised from its location, the pick-up attachment and the pick-up support are structured so as to be brought into a standard position with respect to the dump frame and are restrained in this standard position. The operations can be observed or also automatically controlled by electrical container contacts operated by the container and mounted on the pick-up attachment and the pick-up support.

27 Claims, 4 Drawing Figures

LOADING APPARATUS FOR EMPTYING CONTAINERS INTO A COMMON RECEPTACLE

FIELD OF THE INVENTION

Our present invention relates to a loading apparatus for emptying containers or dumping the contents of containers into a common storage or transport receptacle, bin or the like, and, more particularly, to dump or dump-type lift apparatus for loading the contents of garbage containers into the common bin of a garbage truck.

BACKGROUND OF THE INVENTION

A loading or dump-type apparatus for emptying containers into storage receptacles, bins, compartments, and the like generally comprises a dump frame, a pick-up attachment and a pick-up support attached by at least one mount to the dump frame, at least one guide mechanism and at least one drive mechanism for providing the required dumping and lifting motions of the dump frame to perform the emptying of the containers.

The prior art loading apparatus, particularly dump or dump-type lift apparatus for emptying garbage containers, require comparatively many operating personnel for auxiliary work necessary to get the container to be emptied from its location, to transfer it to the emptying mechanism on the common storage container, and to return the emptied container again to its original location.

Bringing the storage container with the emptying apparatus to the container to be emptied is often time consuming and in many cases is difficult. These operating methods are profitable only when large and heavy containers are to be emptied, for example, those with 5 $m^3$ capacity and more. Also in such a case the operator of the movable storage receptacle, for example, a garbage or dustbin truck, must, after advancing to the container to be emptied usually leave the cab of the truck, in order to properly apply the pick-up support of the emptying mechanism to the container to be emptied.

There are a variety of loading devices known for emptying containers into storage receptacles, for example those in the form of dump or dump-type lift apparatuses. A typical loading apparatus is equipped with a dumping and lifting mechanism, which is brought to and grasps the container to be emptied, raises and dumps it until the contents of the container fall into the inside of the common storage receptacle, and then put the emptied container down into its proper place. Also either rear wall, side wall or top loading is known in the prior art. In each case the known loading apparatus requires auxiliary workers for applying and transferring the container to be emptied to the loading apparatus and for removing the emptied container from the work area. Thus considerable care is required in handling the container to be emptied during its emptying by the loading apparatus.

OBJECTS OF THE INVENTION

It is an object of our invention to provide an improved loading apparatus for emptying the contents of containers into a common container, particularly for emptying garbage containers into the storage compartment of a garbage truck.

It is also an object of our invention to provide an improved dump or dump-type lift apparatus for emptying the contents of containers into a common receptacle.

It is another object of our invention to provide an improved loading apparatus for emptying containers into a common storage receptacle which provides a more reliable pick-up of the containers than those of the prior art.

It is a further object of our invention to provide an improved loading apparatus for emptying containers into a common storage bin which reliably moves to and picks up the containers to be emptied, and does not require that the container be placed exactly manually on the loading apparatus as do those of the prior art.

It is a further object of our invention to provide an improved loading apparatus for emptying containers into a common storage container, particularly for emptying garbage containers into the storage bin of a garbage truck, which has a more automatic, reliable pick-up of the containers to be emptied than those of the prior art.

SUMMARY OF THE INVENTION

These objects and others which will become more apparent hereinafter are attained in accordance with our invention in a loading apparatus for emptying containers into a common storage container, particularly for emptying garbage containers into the storage bin of a garbage truck, comprising a dump frame having a dump axis, a pick-up attachment and a pick-up support for the containers to be emptied attached to at least one mount on the dump frame, at least one guide mechanism and at least one drive mechanism for producing the dumping and lifting motions required of the dump frame in order to empty the containers.

According to our invention the mount of the pick-up attachment and the pick-up support for the container to be emptied on the dump frame are constructed to allow a limited movability of the mount of the pick-up attachment and the pick-up support with respect to the dump frame with the dump frame set in a position to receive the container to be emptied.

Also according to our invention alignment mechanisms for proper orientation and alignment of the mount of the pick-up attachment and the pick-up support for a container being picked-up and raised from its location with respect to the opposing dump frame set in a pick-up position are provided.

Further according to our invention, a restraining mechanism for fixing the pick-up attachment and the pick-up support in a standard or normal position on the dump frame is provided, which is constructed and/or controlled to provide a fixed interlocked engagement of the pick-up attachment and the pick-up support on the one hand and the dump frame on the other hand, in order to achieve a fixed raised position after leaving the pick-up position of the dump frame.

Because of the above structural features the pick-up attachment and the pick-up support on the dump frame can be more or less flexibly fitted to the container to be emptied, when this container is brought together with the pick-up attachment and the pick-up support from one direction or the other oriented somewhat slantedly or laterally staggered with respect to the pick-up attachment and the pick-up support. Because of the movability of the pick-up attachment and pick-up support with respect to the dump frame an appropriate adjustment occurs to provide a reliable engagement of the appropriate parts on the container and in the pick-up attachment during pick-up. In this way an engagement of the loading apparatus and the container to be emptied is provided, so that the container can be easily raised from its location, and by proper alignment of the pick-up attachment and the pick-up support opposing the dump frame, it is possible directly to bring the container to be emptied into the standard position with respect to the dump frame desired and required for emptying. In this normal or standard position, according to our invention, then the pick-up attachment and the pick-up support are restrained or fixed on the dump frame. Thus the same conditions for the loading or emptying process are provided, as in the exact mounting and transfer of a container to a loading apparatus performed with the highest precision.

According to the special requirements and the relationships particularly defined by the container to be emptied and the emptying or dumping mechanism, the number and the type of the degrees of freedom provided for the relative motion of the pick-up attachment and the pick-up support with respect to the dump frame are chosen.

For example, the mount for the pick-up attachment and for the pick-up support is constructed to permit a limited movability of the pick-up attachment and the pick-up support laterally parallel to the dump axis of the dump frame with respect to the dump frame set in position to pick up the container to be emptied. This degree of freedom has a particular significance, because lateral displacement in application of the loading apparatus to a container to be emptied standing in a particular location might be normally difficult or at least required employment of additional information gathering steps, in order to reliably place the loading apparatus in engagement with the appropriate parts of the container for an exact fit required for an exact reliable pick-up. By the limited lateral adjustability of the pick-up apparatus and the pick-up support of the loading apparatus the bringing together of the loading apparatus with the container to be emptied can be performed with greater precision. Moreover the pick-up apparatus and the pick-up support by an easy lateral shift with respect to the dump frame can be precisely placed against the corresponding parts of the container to be grasped and then, when the container is easily raised from its location, the precise lateral alignment with respect to the dump frame for the emptying process can be made.

Another degree of freedom for motion of the pick-up attachment and the pick-up support is provided by our invention by construction of the mount for the pick-up attachment and the pick-up support to allow a limited swinging of the pick-up attachment and the pick-up support about a substantially central vertical axis of the dump frame in the pick-up position. This degree of freedom of motion has particular significance with bar shaped pick-up attachments and pick-up supports which are provided for the pick-up of relatively wide containers. By the limited rotatability of the pick-up attachment and the pick-up support about the substantially vertical central axis of the dump frame, the pick-up attachment and pick-up support in a slanting contact with the container to be emptied can pivot until the pick-up attachment reaches a suitable parallel position for engaging the parts of the container to be grasped, in order to guarantee a satisfactory reliable engagement and to raise the container to be emptied from its location by raising the dump frame. When this occurs, the container to be emptied can be oriented and aligned in the correct normal position for the emptying process with respect to the dump frame.

A further degree of freedom of motion according to our invention of the mount of the pick-up attachment and the pick-up support with respect to the dump frame is provided by construction of the pick-up attachment and pick-up support to allow a limited swinging motion of the pick-up attachment and also the pick-up support in a substantially vertical plane parallel to the dump axis of the dump frame with the dump frame set in a pick-up position. This limited movability of the pick-up attachment and also the pick-up support with respect to the dump frame allows the pick-up attachment, particularly bar shaped pick-up attachments for wider containers, at the start of the lifting of the dump frame to be aligned over its entire length or over the entire width of the container to be emptied in the raised position against the elements of the container to be grasped and to make a reliable engagement over the entire container width. That safe engagement being made, then for further lifting and dumping the container to be emptied is raised from its location. The standard correct position of the pick-up attachment and the pick-up support for emptying with respect to the dump frame, and thus emptying of the container, can, therefore, be reached.

Finally also according to our invention another degree of freedom of motion of the pick-up attachment and the pick-up support with respect to the dump frame is provided by constructing the pick-up attachment and also the pick-up support, to allow a limited slanting motion of the pick-up attachment and also the pick-up support in a plane normal to the dump axis of the dump frame. Hereby the possibility of maintaining more easily the pick-up attachment and the pick-up support in a reliable, opposing engagement with the container to be emptied is provided.

In a preferred embodiment of our invention the pick-up attachment and pick-up support for the container to be emptied are mounted on a pick-up frame member extending substantially vertically with the dump frame set in position to pick-up the container to be emptied, where this pick-up frame member by means of the mount allowing a limited movability of the pick-up attachment and the pick-up support is attached to the dump frame. By the pick-up frame member an adjustable unity to the apparatus is provided in the sense of the limited movability provided by the chosen degrees of freedom with respect to the dump frame and, therefore, with respect to the container to be emptied. The pick-up frame member can be mounted at its upper end region by means of a swivel joint on the dump frame and under this swivel joint a motion-limiting device effective between the dump frame and the pick-up frame member is provided. According to the type and number of the desired degrees of freedom of motion, this swivel joint can be constructed as a universal joint having a motion-limiting mechanism in the form of a bushing device or of a ball-and-socket joint. This motion-limiting mechanism may take the form of a rubber-metal composite element. The alignment mechanism to be used with such a device for alignment of and fixing in position the pick-up frame member with respect to the dump frame can particularly be constructed as a pair of twin guide rails or side walls comprising a receiving guide (which may be shaped like a circular arc and mounted in a plane perpendicular to the dump axis), between which a protruding member mounted on the pick-up frame member is guided. The clearance space between the guide rails determines the degree of mobility of the pick-up frame member with respect to the dump frame.

In further preferred features of our invention, a spur is attached to the protruding member perpendicular thereto and projecting downward with the dump frame in the pick-up position. The spur is positioned so the limits of the swinging of the pick-up frame member are partially determined by contacts of the spur and the pick-up frame member on a lower transverse frame member of the dump frame.

Advantageously, the receiving guide is divided into a first region in which the clearance space between the guide rails is such that the protruding member just fits therebetween so that movability is effectively prevented, when the dump frame is in a raised position, and a second region into which said protruding member extends when the dump frame is in its pick-up position in which the guide rails spread away from each other forming a wedge-shaped widened clearance space. Thus adjustments of the pick-up attachment and pick-up support with respect to the dump frame are possible when the protruding member extends into this second region of the receiving guide.

Another possibility for providing a limited movability of the pick-up frame member with respect to the dump frame comprises mounting the pick-up frame member at its upper end region by means of a swivel joint to the dump frame, the swivel joint being structured for alignment of the pick-up attachment and the pick-up support and for developing an automatic restoring force due to displacement from its rest position.

A particularly simple form for this swivel joint comprises a rubber-metal-composite element, for example a universal joint such as a ball-and-socket joint or a bushing device. Such a joint has the advantage that the alignment and orientation of the pick-up container with respect to the dump frame is conducted automatically and immediately, as soon as the container is raised from its location by adjustments of the swivel joint developing suitable restoring forces due to displacement from its rest position.

A mechanism of this kind needs only a restraining device for holding the pick-up frame member fixed in its normal position on the dump frame. One such restraining device can be mounted, for example, pivotally on the dump frame and in its closed configuration surrounds the pick-up frame member like a clamp and has controllable restraining jaws.

For laterally limiting the motion of the pick-up frame member the swivel joint between the pick-up frame member and the dump frame is mounted inside of a laterally shiftable spring-loaded centering mechanism attached to the dump frame.

Since the loading apparatus of our invention provides for a twin alignment process of the container to be emptied with respect to the dump frame for conducting a particular emptying process, namely, (a) alignment of the pick-up attachment and the pick-up support with respect to the container to be emptied, and (b) alignment of the pick-up attachment and the pick-up support together with the container to be picked-up with respect to the dump frame, It is appropriate to provide protection so that these alignment processes are run correctly before further steps in the emptying process. To this end the pick-up attachment has a container gripping member with its long axis extending substantially parallel to the dump axis of the dump frame and the pick-up, this container gripping member preferably being shaped like a bar, and the pick-up support has a corresponding bottom support, also preferably bar-like, extending parallel to the container gripping member of the pick-up attachment. The container gripping member and the bottom support on their lateral surface or sides turned toward the container to be picked up are provided with at least one electrical container contact for signal transmission or for automatic activation of the lifting motion of the dump frame, by which a switching process is only jointly activated. Preferably on the container gripping member at least two contacts can be positioned in a line parallel to the long axis of the container gripping member with clearance from each other, by which the switching process is activated only by joint contact.

A preferred embodiment of our invention can be constructed as a dump-type lift apparatus, and is particularly characterized by a dump frame supporting the mount for the pick-up attachment and pick-up support, which is constructed to allow a limited movability. This dump frame by means of a four rod pivot is mounted on a pivoting arm and/or a pair of pivoting arms, whereby the alignment mechanism for the pick-up attachment and the pick-up support as well as the restraining mechanism for holding the pick-up attachment and the pick-up support are mounted on the pivoting arm or twin pivoting arms. In another preferred embodiment of our invention a dump-type lift apparatus is particularly characterized by a dump frame supporting a mount for the pick-up attachment and pick-up support which is constructed to allow a limited movability, which is guided running along a pivoting arm or guide in a kind of vehicle or cart, whereby an alignment mechanism for alignment of the pick-up attachment and the pick-up support and the restraining mechanism for holding fixed the pick-up attachment and the pick-up support are themselves mounted on the dump frame.

Finally according to our invention, a dump or dump-type lift apparatus is particularly characterized by a dump frame supporting a mount for the pick-up attachment and also for the pick-up support constructed to allow limited movability, which is mounted at the free end of an extendable member of a lifting means provided on a common storage container, and supports an alignment mechanism for alignment of the pick-up attachment and the pick-up support as well as the restraining mechanism for holding fixed the pick-up attachment and also the pick-up support.

BRIEF DESCRIPTION OF THE DRAWING

The above and other objects, features and advantages of our invention will become more readily apparent from the following description, reference being made to the accompanying drawing in which.

SPECIFIC DESCRIPTION

Figure 1:
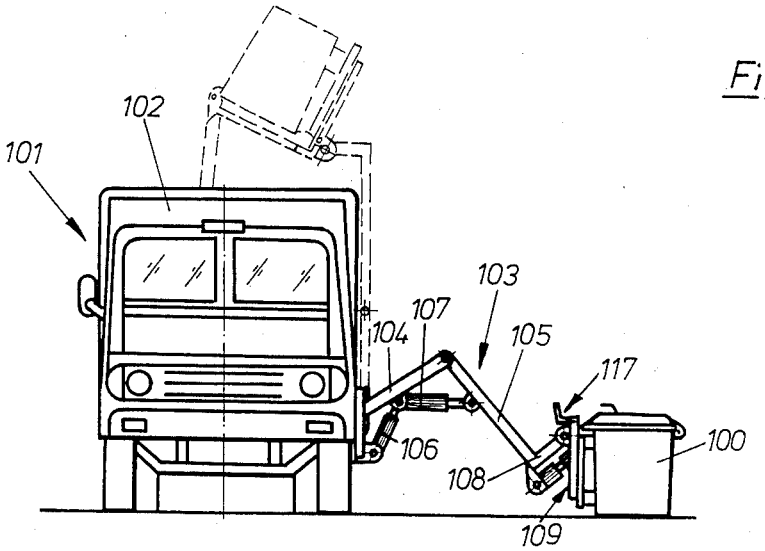
FIG. 1 is a side view of a preferred embodiment of a loading apparatus for emptying garbage from garbage containers according to our invention into the storage chamber of a garbage truck.
Figure 2:
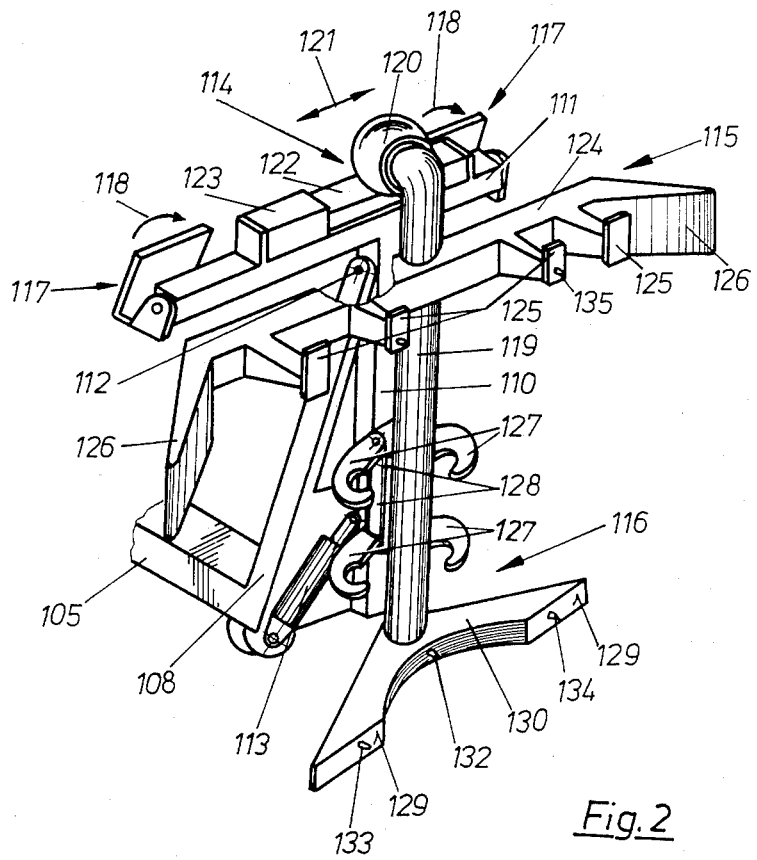
FIG. 2 is a perspective view of a part of the dump mechanism at the free end of an extendable member of the apparatus of FIG. 1.

In the embodiment shown in FIGS. 1 and 2 the common storage container or bin 102 carried by a garbage truck 101 is provided on its side with an extendable member 103, which has two arms pivotally connected to each other, namely a lower arm 104 and an upper arm 105. The lower arm 104 is attached to the garbage truck frame so as to be pivotable around an axis parallel to the travel direction of the garbage truck 101 and is also connected to that frame with a first piston cylinder arm drive 106, by means of which the arm 104 is pivotable upwards and downwards.

The upper arm 105 is attached pivotally at the free end of the lower arm 104 so as to be swingable about an axis parallel to the travel direction of the garbage truck 101. Between the lower arm 104 and the upper arm 105 a second piston-cylinder arm drive 107 is installed, with which both arms 104 and 105 can be spread from or folded toward each other. The upper arm 105 carries at its free end an end segment 108 bent approximately at right angles to upper arm 105.

At the free branched end of this end segment 108 in this first embodiment, a T-shaped dump frame 109, with its vertical T-leg 110 half the thickness of the horizontal T-arm 111, is pivotable around an axis 112 approximately parallel to the travel direction of the garbage truck 101.

Between the end segment 108 and the vertical T-leg 110 of the dump frame 109 a piston-cylinder dump frame drive 113 is installed.

The dump frame 109 carries on the upper side of its horizontal T-arm 111 a mount 114, for a pick-up attachment 115 and a pick-up support 116. Moreover the dump frame 109 has foldable, flap-shaped clamps 117 on its horizontal T-arm 111, which normally are swung back into the rear position shown in FIG. 2 and are swingable in the direction shown by the arrow 118 over the open edge of a garbage container 100 gripped by the pick-up attachment 115 for emptying.

The pick-up attachment 115 and the pick-up support 116 in this embodiment are rigidly attached to each other by a pick-up frame member 119 extending essentially vertically in engagement with the dump frame 109. The pick-up frame member 119 is connected by means of mount 114 with the horizontal T-arm 111 of the dump frame 109.

In the embodiment of FIGS. 1 and 2 this mount 114 comprises a rubber-metal-composite element 120 formed as a ball-and-socket joint, in which the inner surface of the ball socket and the outer surface of the pivot ball attached to the pick-up frame member 119 are connected by a rubber filler, wherein this rubber filler is prevulcanized on the inner surface of the ball socket and the outer surface of the pivot ball.

The rubber-metal-composite element 120 has in this manner a rest or equilibrium position and is attached from the front (i.e., the front as viewed facing the side of the garbage truck 101 or the lower arm 104).

It may be swung from this rest position by exterior bending forces in any direction, however it continually tries to return to its rest position. Naturally, the movability or bendability of the rubber-metal composite element 120 is limited.

Additionally, besides the limited pivotability of the rubber-metal-composite element 120, this mount 114 offers the possibility of a lateral shift in position according to the double arrows 121 seen in FIG. 2. This lateral shift is allowed because the rubber-metal-composite element 120 is fitted to a rectangular cross-sectioned bar 122, which is axially slidable in rectangular guide sleeve 123.

In this guide sleeve 123 restoring springs are installed, which hold the rectangular cross-sectional bar 122 with the rubber-metal-composite element 120 under the force of the compressed restoring springs in the middle position shown in FIG. 2.

The pick-up attachment 115 has a container gripping member 124 extending with long axis transverse to and mounted rigidly to the pick-up frame member 119, to which gripping plates 125, which grip under the edge of the garbage container 100, are attached. At its outer ends the bow-shaped container gripping member 124 is provided with slanted, tapered container guides 126.

These container guides 126 are therefore formed to grip and engage the sidewalls on the garbage container 100 as the container gripping member 124 with its container guides 126 is brought forward to it, and thereby under the spring-like response of the rectangular cross-sectioned bar 122, the container gripping member 124 with its gripping plates 125 is put in position laterally in engagement with the container 100.

On the vertical T-leg 110 of the dump frame 109 two pairs of clamp-restraining members 127 are mounted, which are normally shown in the open position shown in FIG. 2 and by means of a closing device 128 operated with electrical, pneumatic, hydraulic or mechanical means are adjustable and controllable in a restraining position, in which they surround the pick-up frame member 119 in clamp-free fashion and restrain the vertical T-leg 110 of the clamp frame 109.

In operation the loading apparatus described above by suitable operation and control of the extendable member 103 is applied to a garbage container 100. Thereby the container gripping member 124 with its container guides 126 engages the side walls of the garbage container 100, so that the container gripping member 124 is laterally positionable against the garbage container 100.

When the gripping plates 125 of the pick-up attachment 115 and the bottom support lateral surfaces 129 of the pick-up support 116, comprising the bottom support 130 extending transverse to the pick-up frame member 119, come into contact with the side wall of the garbage container 100, the bottom support lateral surfaces 129 and the surfaces of the gripping plates 125 by flexible adjustment of the rubber-metal-composite element 120 adjust themselves to the sidewall surfaces of the garbage container 100.

The container 100 is then raised by operation of the extendable member 103. Because of that the gripping plates 125 engage in corresponding catch pieces, for example a catch lip of the garbage container 100. Thereby the container gripping member 124 adjusts itself into position by flexible adjustment of the rubber-metal-composite element 120 against the catch lip or catch pieces of the garbage container 100. Further in the course of the raising of the dump mechanism with the extendable member 103 the garbage container 100 is raised from the ground so that the compressible spring operating on the rectangular shaped bar 122 and the rubber-metal-composite element 120 adjust the pick-up frame member 119 into its normal position against the dump frame 109. By operation of the closing device 128 the clamp-like restraining member 127 closes around the pick-up frame member 119. A possible still further adjustment of the pick-up frame member 119 against the dump frame 109 for emptying of the containers 100 is thereby necessarily eliminated.

As soon as the pick-up frame member 119 together with the pick-up attachment 115 and the pick-up support 116 as well as the container 100 are locked into their standard position, by suitable control of its operating mechanism the flap-shaped clamping device 117 is swung over the open edge of the container 100. By further operation of the extendable member 103 the container 100 is brought into the emptying position shown by dotted lines in FIG. 1. After the emptying occurs, the above-described operation steps are run in reverse and in reverse sequence until the container 100 is again put in its place.

Figure 3:
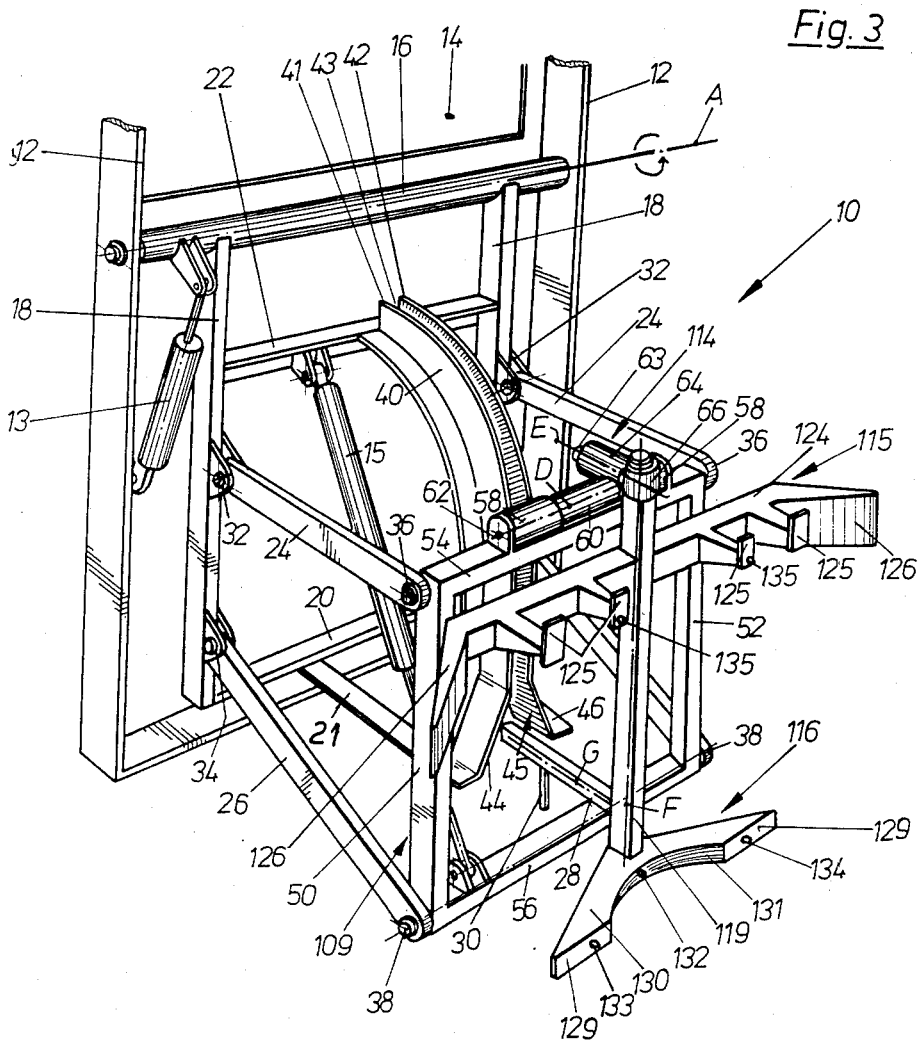
FIG. 3 is a perspective view of another preferred embodiment of the loading apparatus of our invention for emptying containers into a common storage container.
Figure 4:
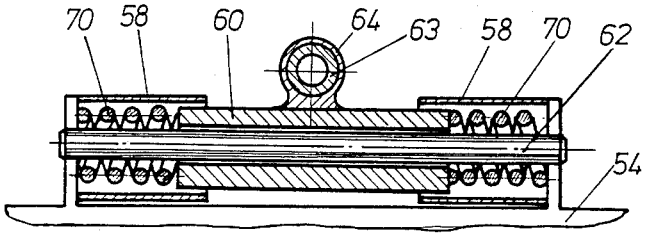
FIG. 4 is a cross-sectional view of a part of the dump mechanism of the apparatus of FIG. 3.

In FIGS. 3 and 4 a second embodiment of a dump-type lift apparatus according to our invention is shown, which is mounted with a frame 12 on a loading port 14 on the rear or sidewall of a common storage bin or container, for example the storage compartment 102 of a garbage truck 101 as shown in FIG. 1.

Under the loading port 14 in the transverse direction A a supporting shaft 16 is mounted in the frame 12, on which two pivoting arms 18 are attached and by means of a cylinder-piston lifting device 13 are jointly rotatable by rotation of the supporting shaft 16.

On the pivoting arms 18 in this embodiment the dump frame 109 is mounted by means of twin pivotable upper guide rods 24 and twin pivotable lower guide rods 26, so that the four pivot axes found at the pivots 32 and 34 and 36 and 38 are parallel to each other and the transverse direction A. The dump frame 109 in this embodiment comprises four frame members, namely two side frame members 50 and 52, an upper transverse frame member 54, and a lower transverse frame member 56.

The relative motion of the dump frame 109 to or from the pivoting arms 18 in this four-rod pivot occurs by means of a piston cylinder extending drive 15 mounted between the lower transverse frame member 56 of the dump frame 109 and a transverse brace bar 22 mounted on the pivoting arm 18.

As in the first embodiment shown in FIGS. 1 and 2 the pick-up attachment 115 and the pick-up support 116 are attached to a pick-up frame member 119, which at its upper end region is attached movably to the upper transverse frame member 54 of the dump frame 109.

Moreover on this upper surface of the upper transverse frame member 54 two coaxial guide sleeves 58 are mounted, which each contain a compressible spring 70. Between the outer front walls of the guide sleeves 58 guide sleeve shaft 62 is positioned, whose axis D is parallel to transverse direction A defined by the long axis of the supporting shaft 16.

Between the compressible springs 70 is a bushing sleeve 60 in which shaft 62 is rotatably mounted. On this bushing sleeve 60 a first socket 64 is attached oriented perpendicularly to the axis D of the bushing sleeve 60. In this first socket 64 a bolt or a socket 63 is pivotally mounted, which at its end turned toward the pick-up attachment 115 has a receptacle 66, in which the pick-up frame member 119 is pivotally held. The long axis F of the pick-up frame member 119 stands perpendicular to the long axes E of the sockets 63 and 64.

As in the first embodiment shown in FIGS. 1 and 2 at the top portion of the pick-up frame member 119 the container gripper 124 shaped somewhat like a bar is attached, which has in this second embodiment four gripping plates 125 and at each of its ends container guides 126. At the lower end portion of the pick-up frame member 119 the pick-up support 116 is mounted, formed by the bottom support 130, on which are formed the bottom support lateral surfaces 129 and a central curved-in region 131.

The pick-up support 116 is in this embodiment constructed with three electrical container contacts, namely a center container electrical contact 132 in central region 131 of bottom support 130 and two outer electrical container contacts 133 and 134 mounted on the bottom support lateral surface 129.

Additional electrical container contacts 135 are provided on the central gripping plates 125 of the pick-up attachment 115. Further, the dump frame 109 is provided with a clamping mechanism for the container to be picked-up, which can be formed in a similar or identical way, as in the embodiment shown in FIGS. 1 and 2.

On the bottom portion of the pick-up frame member 119 a protruding member 28 whose long axis G is approximately perpendicular to the long axis F of the pick-up frame member 119 is provided, which extends and supports a spur 30 inside of the dump frame 109, so that the lower transverse frame member 56 of the dump frame 109 lies between the lower end region of the pick-up frame member 119 and the spur 30.

Exterior to (or below in the resting apparatus) the upper transverse brace bar 22, a lower transverse brace bar 20 is attached between each pivoting arm 18, so that a rigid pivoting frame is formed. On this pivoting frame a receiving guide 40 is mounted, which comprises two guide rails or side walls 41 and 42. These wall-like guide rails 41 and 42 are formed shaped as circular arcs adjacent each other and in a first upper region of receiving guide 40 are spaced from each other with a constant clearance in planes which are perpendicular to the long axis A of the supporting shaft 16.

In a lower second region 45 of receiving guide 40, both side walls or guide rails 41 and 42 spread away from each other, so that the clearance space 43, which is constant in the first upper region, is wedge-shaped in the second lower region indicated by sidewall portions 44 and 46 and widens in a direction away from the first upper region.

The receiving guide 40 is mounted with two mounting bars 21, which are attached to the side-wall portions 44 and 45 of each of the guide rails 41 and 42, to the lower transverse brace bar 20 of the two pivoting arms 18.

The receiving guide 40 is itself formed with a curved shape so that in a lifting operation of the dump frame 109 into a raised position te protruding member 28 of the pick-up frame member 119 extends constantly between each of the guide rails 41 and 42.

The loading or dump-type lift apparatus according to FIGS. 3 and 4 functions according to the following:

A heavy container (not shown in FIGS. 3 and 4) is applied to the loading apparatus 10, or the dump-type lift apparatus 10 moves against the container to be emptied, the container guides 126 gripping the side walls of the container, after the loading apparatus 10 has engaged it. Between the container to be picked up and the pick-up attachment 115 a lateral displacement can occur causing a lateral shift of the bushing sleeve 60 between the compressible springs 70 and therefore an adjusting lateral shift of the pick-up frame member 119 and the container gripping member 124.

As soon as the pick-up attachment 115 and the pick-up support 116 come into contact with the container to be picked-up, the container gripping member 124 and the bottom support 130 are sort of skewed or slanted, so that they are aligned perpendicular and parallel to the standing garbage container or the like which is somewhat skewed or slanted in place on the ground.

The container then contacts, according to the size and shape of the container the bottom support lateral surfaces 129 or the curved-in region 131 of the bottom support 130 and activates the electrical container contacts 132, 133, or 134, present there. This also applies to the contacts 135 of the gripping plates 125 coming into contact with the container wall.

Thus the container gripping member 124 is aligned parallel to the container wall and both contacts are then jointly operated.

In operation, activation of at least one of the electrical container contacts 132, 133 or 134, on the bottom support 130 as well as the two contacts 135 on the container gripping member 124 is required, so that the exact correct fit of the container gripping member 124 and the bottom support 130 on the container to be emptied occurs, and the container is gripped properly by the gripping plates 125 of the container gripping member 124, before lifting and dumping begins.

The operating switching process can also be so set up that by operation of the electrical container contacts, 132, 133, 134, and 135, a signal is provided to the truck driver in the truck cab or the operator of the loading apparatus who may be outside of the vehicle involved, so that the particular emptying process can now be conducted. It is however also possible to use the simultaneous operation of these contacts in order to automatically activate the particular emptying process.

The skewed orientation of the pick-up frame member 119 is limited by contact of the protruding member 28 on the guide rails 41 and 42 in the second bottom region 45 of the receiving guide 40. The pick-up frame member 119 can rotate itself only so far arounds its long axis F or swing only so far about the axis E, as is allowed by the spreading of the side walls 41 and 42 in the second bottom region indicated by 44 and 46 of the receiving guide 40 to accommodate the protruding member 28. The greater this spreading, the greater is the allowed rotation and swinging of the pick-up frame member 119. In the other possible swinging direction, which is allowed by rotation of the bushing sleeve 60 around the axis D, the pick-up frame member 119 is limited in its swinging by either contact of the spur 30 or the bottom region of the pick-up frame member 119 on the lower transverse frame member 56.

In the subsequent lifting motion of the dump frame 109 and therefore of the pick-up frame member 119 the container to be emptied is lifted from the ground and the protruding member 28 moves up into the funnel-shaped spreading portion of the second lower regio 45 of the receiving guide 40. Thereby the pick-up frame member 119 is swung from its skewed or slanted position and becomes better centered until it is locked in the lifting position or raised position, in which the protruding member 28 lies in the first upper region of the receiving guide 40 in the clearance space 43 formed between the guide rails 41 and 42. In this position the pick-up frame member 119 is restrained from further rotation or swinging.

In setting down an empty container the protruding member 28 again arrives in the spread second lower region 45 of the receiving guide 40, so that in putting down of the container on slanted or skewed ground the pick-up frame member 119 can move together with the container, until it stands securely in position on the ground.

In a modified arrangement in contrast to FIG. 3 the receiving guide 40 can also be attached to the frame 12. In this case the protruding member 28 also slides with the swinging motion of the twin pivoting arms 18 in the first upper region of the receiving guide 40, while in the second embodiment shown in the drawings it does not change its position in the receiving guide 40 with the swinging motion of the twin pivoting arms 18. Correspondingly each guide rail 41 and 42 must be constructed essentially longer in this case in order to mount the receiving guide 40 on the frame 12.

In the first embodiment of FIGS. 1 and 2 in a similar way as in the second embodiment of FIGS. 3 and 4 electrical container contacts 133 and 134 are mounted on the bottom support lateral surfaces 129 and an electrical contact 132 is mounted in the approximate center of the curved-in region 131 of the bottom support 130. Likewise the electrical container contacts 135 are provided in the central gripping plates 125.

These container contacts 135 are so constructed, that with simultaneous operation of each electrical container contact 135 and at least one of the contacts 132, 133, and 134 a ready signal is given to the loading apparatus operator or to the truck driver operating the extendable member 103, in order to indicate that the container 100 to be emptied is ready to be lifted and the extendable member 103 now can be operated in the particular emptying process for a particular container 100.

Alternatively additional electronic switching circuits can be provided in this case, so that simultaneous operation of the three named electrical container contacts can set in motion automatic operation of the lifting and dumping operations of the extendable member 103 and other parts of the loading apparatus.

Many modifications of the described embodiments are possible and take a variety of forms. So it is not absolutely required, that the component part limiting the pick-up frame member 119 in its skewed or slanted position acts on the protruding member 28 mounted on the pick-up frame member 119 along or directly on the container gripping member 124 and/or the bottom support 130. Further it is possible based on the second embodiment according to FIGS. 3 and 4, to provide locking positions on the axes, so that a rotation of the bushing sleeve 60 and/or the socket 63 of the pick-up frame member 119 occurs by a known preset operating force. Because of that the pick-up frame member 119 during its approach to the container to be emptied does not shake uncontrollably. Also additional damping devices can be provided, which restrain the pick-up frame member 119 and/or the dump frame 109 during the travels of the garbage truck 102 or other portable container.

Instead of the structure shown in the drawings the pick-up attachment 115 can also occur in other structural forms, which fit the container to be emptied. Likewise also instead of the structure for the pick-up support 116 given in the specific embodiments, other structural forms for the pick-up support 116 fitting the container to be emptied can also be provided.

As FIG. 2 shows, in these embodiments container electrical contacts 132, 133, and 134 on the bottom support 130 and the container electrical contact 135 on the gripping plates 125 or a plurality of gripping plates 125 can be provided. These contacts can function thereby in the same way as in the second specific embodiment shown in FIGS. 3 and 4.

We claim:

1. In a loading apparatus for emptying a garbage container into a common storage bin, comprising a garbage truck, a first dump frame mounted to said garbage truck, swingable arms pivotable at one end on said first dump frame about a horizontal first dump axis, a second dump frame mounted on said arms to pivot about a second dump axis parallel to and spaced from said first dump axis, a pick-up attachment and support engageable with said container and connected by at least one mount with said second dump frame, and at least one guide mechanism and at least one drive mechanism for said arms and said second dump frame for providing lifting and dumping motions of a container engaged by said pick-up attachment and support, the improvement wherein:

at least one of said mounts for said pick-up attachment and support is provided with means enabling at least one degree of freedom of limited movability of said pick-up attachment and support with respect to said second dump frame for self alignment of said pick-up attachment and support into a pick-up position with respect to a container located outside the garbage truck in a position of said container to be gripped by said pick-up attachment and support to be emptied;

said guide mechanism includes at least one alignment mechanism on said second dump frame for aligning said pick-up attachment and support with said container engaged thereby and raised from the ground with a fixed standard position of the container with reference to said second dump frame; and said guide mechanism further includes at least one restraining mechanism on said second dump frame engageable with said pick-up attachment and support when said pick-up attachment and support is in a fixed standard position to provide an interlocked engagement between said pick-up attachment and support and said second dump frame for raising of a container engaged by said pick-up attachment and support from said pick-up position to a predetermined second raised position.

2. The improvement according to claim 1 wherein said mount of said pick-up attachment and support has limited lateral movability in a direction substantially parallel to said second dump axis of said second dump frame in said pick-up position.

3. The improvement according to claim 1 wherein said mount of said pick-up attachment and support has limited swinging movability about a substantially vertical central axis of said second dump frame in said pick-up position.

4. The improvment according to claim 1 wherein said mount for said pick-up attachment and support has limited swinging movability in a substantially vertical plane substantially parallel to said second dump axis of said second dump frame in said pick-up position.

5. The improvement according to claim 1 wherein said mount for said pick-up attachment and support has limited slanting movability in a plane perpendiclar to said second dump axis of said second dump frame.

6. The improvement according to claim 1 wherein said pick-up attachment and support are mounted on an elongated pick-up frame member extending substantially vertically in said pick-up position of said second dump frame, and said pick-up frame member is attached by means of said mount for at least one degree of freedom of limited movability of said pick-up attachment and support with respect to said second dump frame.

7. The improvement according to claim 6 wherein said mount is a swivel joint and an upper end region of said pick-up frame member is mounted on said second dump frame by means of said swivel joint, said second dump frame being provided with said alignment mechanism effective between said pick-up frame member and said second dump frame.

8. The improvement according to claim 7 wherein said pick-up frame member is positively held in said raised position of said second dump frame by engagement with a first region of a receiving guide forming a part of said alignment mechanism, which comprises two guide rails which are oriented with a clearance space between each other and parallel to a plane perpendicular to said second dump axis of said second dump frame, whereby said clearance space is such that a motion of said pick-up frame in a direction parallel to said second dump axis of said second dump frame is not possible, when said second dump frame is in said raised position.

9. The improvement according to claim 8 wherein said pick-up frame member is limitedly aligned by a second region of said receiving guide, when said second dump frame is in said pick-up position, said second region of said receiving guide being formed by a wedge-shaped widening of said clearance space between said guide rails in a direction away from said first region.

10. The improvement according to claim 9 wherein a protruding member is attached to said pick-up frame member, a long axis of said protruding member being oriented perpendicularly to the long axis of said pick-up frame member and said protruding member extending in a direction through and beyond said second dump frame, and is of such a length that said protruding member with said second dump frame in said pick-up position is located in said second region of said receiving guide and in said raised position in said first region of said receiving guide, whereby said clearance space between said guide rails in said first region matches the width of said protruding member, so that motion of said protruding member is not possible in a direction parallel to said second dump axis.

11. The improvement according to claim 10 wherein said protruding member has a spur forming a part of said restraining mechanism attached thereto, which is oriented substantially parallel to said long axis of said pick-up frame member, wherein said transverse frame member of said second dump frame is positioned between said pick-up frame member and said spur.

12. The improvement according to claim 11 wherein limits of the swinging motion of said pick-up frame member in a plane perpendicular to said second dump axis of said second dump frame are fixed by the distance of said spur from said pick-up frame member, and said limits of said swinging motion are defined by contacts of said transverse frame member of said second dump frame on said spur and said pick-up frame member.

13. The improvement according to claim 9 wherein limits of swinging motion of said pick-up frame member in said pick-up position in a substantially vertical plane parallel to said second dump axis of said second dump frame are defined by the contacts of a protruding member of said pick-up frame member laterally on said guide rails in said second region of said receiving guide.

14. The improvement according to claim 9 wherein limits of rotating motion of said pick-up frame member about the long axis of said pick-up frame member are defined by the contact of a protruding member of said pick-up frame member with each of said guide rails in said second region at said receiving guide.

15. The improvement according to claim 6 wherein said mount is a swivel joint and an upper end region of said pick-up frame member is mounted on said second dump frame by means of said swivel joint formed as a universal joint having a motion-limiting mechanism.

16. The improvement according to claim 15 wherein said universal joint is a bushing device and said motion limiting mechanism comprises a rubber-metal-composite element.

17. The improvement according to claim 15 wherein said universal joint comprises a ball-and-socket joint and said motion-limiting mechanism comprises a rubber-metal-composite element.

18. The improvement according to claim 6 wherein the upper-end region of said pick-up frame member is mounted on said second dump frame by means of a swivel joint and a receptacle is mounted on said swivel joint, in which said pick-up frame member is supported so as to be rotatable about the long axis of said pick-up frame member, whereby said long axis of said pick-up frame member is substantially vertically oriented in said pick-up position of said second dump frame.

19. The improvement according to claim 6 wherein the upper end region of said pick-up frame member is mounted on said dump frame by means of a swivel joint, which develops an automatic restoring force when displaced from a rest position, and equally comprises a part of said guide mechanism for aligning said pick-up attachment and said pick-up support.

20. The improvement according to claim 19 wherein said swivel joint is a universal joint, constructed as a rubber-metal-composite element.

21. The improvement according to claim 19 wherein said restraining mechanism has a plurality of jaws controllable in a closed configuration surrounding in a clamp-like fashion said pick-up frame member pivotally mounted on said dump frame.

22. The improvement according to 6 wherein the upper-end region of said pick-up frame member is mounted on said second dump frame by a swivel joint and said swivel joint is mounted between said second dump frame and said pick-up frame member inside of a spring-loaded centering mechanism limited to lateral displacement on said dump frame.

23. The improvement according to claim 1 wherein said pick-up attachment comprises a container-gripping member whose long axis extends substantially parallel to said second dump axis of said second dump frame and said pick-up support comprises a bottom support substantially parallel to said container-gripping member, and on the side of said container-gripping member and said bottom support turned toward said container to be picked-up at least one electrical container contact is placed for signal transmission so as to be able to provide an automatic activation of the motions of said second dumping frame for the emptying process, whereby a switching process is activated only by joint operation of at least two of said electrical container contacts.

24. The improvement according to claim 23 wherein on said container-gripping member at least two of said electrical container contacts are positioned with clearance from each other on a line parallel to said long axis of said container-gripping member, and wherein only by joint operation of three of said electrical container contacts is said switching process activated.

25. The improvement according to claim 1 wherein said second dump frame is mounted by means of a four rod pivot on at least one pivoting arm, whereby said aligmment mechanisms for alignment of said pick-up attachment and said pick-up support as well as said restraining mechanism for fixing in place said pick-up attachment and said pick-up support are mounted by at least one of said pivoting arms.

26. The improvement according to claim 1 wherein said said second dump frame is guided along a pivoting arm, whereby said alignment mechanisms for aligning said pick-up attachment and said pick-up support and said restraining mechanism for holding fixed in position said pick-up attachment and said pick-up support are mounted on said second dump frame.

27. The improvement according to claim 1 wherein said dump second frame is mounted on the free end of an extendable member of a lifting means provided on said common storage bin, and also supports said aligning mechanisms for alignment of said pick-up attachment and said pick-up support as well as said restraining mechanism for fixing in position said pick-up attachment and said pick-up support.

* * * * *